US008035592B2

(12) United States Patent
Cheon

(10) Patent No.: US 8,035,592 B2
(45) Date of Patent: Oct. 11, 2011

(54) DISPLAY DEVICE APPARATUS, APPARATUS AND METHOD FOR DRIVING THE SAME

(75) Inventor: Man-Bok Cheon, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 972 days.

(21) Appl. No.: 11/954,071

(22) Filed: Dec. 11, 2007

(65) Prior Publication Data

US 2011/0080440 A1 Apr. 7, 2011

Related U.S. Application Data

(63) Continuation of application No. 10/863,420, filed on Jun. 8, 2004, now Pat. No. 7,321,351.

(30) Foreign Application Priority Data

Jun. 9, 2003 (KR) ..... 10-2003-0036905

(51) Int. Cl.
*G09G 3/36* (2006.01)

(52) U.S. Cl. ..... 345/89; 345/212; 345/213

(58) Field of Classification Search ..... 345/87–100, 345/204, 211–213
See application file for complete search history.

(56) References Cited

U.S. PATENT DOCUMENTS

| | | | |
|---|---|---|---|
| 5,699,076 | A | 12/1997 | Tomiyasu |
| 5,844,533 | A | 12/1998 | Usui et al. |
| 6,903,716 | B2 | 6/2005 | Kawabe et al. |
| 7,154,463 | B2 | 12/2006 | Kwag |
| 2002/0008684 | A1 | 1/2002 | Udo et al. |
| 2002/0015017 | A1 | 2/2002 | Kwag |
| 2003/0001810 | A1 | 1/2003 | Yamaguchi et al. |
| 2003/0020677 | A1 | 1/2003 | Nakano |
| 2003/0080983 | A1 | 5/2003 | Someya et al. |

FOREIGN PATENT DOCUMENTS

| | | | |
|---|---|---|---|
| JP | 09-274796 | A | 10/1997 |
| JP | 2001356737 | | 12/2001 |
| JP | 2002-156950 | A | 5/2002 |
| JP | 2003-202845 | A | 7/2003 |

OTHER PUBLICATIONS

Chinese Office Action and English translation thereof for Application No. 200410047969.0 dated Aug. 27, 2007.

*Primary Examiner* — Kimnhung Nguyen
(74) *Attorney, Agent, or Firm* — Cantor Colburn LLP

(57) ABSTRACT

An apparatus for driving a display device includes a timing controller and a data driver. The timing controller encodes first gray scale data of a present frame, decodes encoded second gray scale data of a previous frame, compares the first gray scale data with the second gray scale data, and generates compensated gray scale data based on a result of comparing the first gray scale data with the second gray scale data. The data driver generates data signal based on the compensated gray scale data to provide the data lines with the data signal. The gray scale data are encoded so that the toggle number between adjacent data pins into which the gray scale data are output may be reduce. The encoded gray scale data are stored in a memory. Thus, the power consumption is reduced, and the EMI may be reduced.

22 Claims, 9 Drawing Sheets

FIG. 9

| N | N1 | N2 | DPOL |
|---|---|---|---|
| 0 | 0 | 0 | 0 |
| 1 | 1 | 1 | 0 |
| 2 | 2 | 2 | 0 |
| 3 | 3 | 3 | 0 |
| 4 | 4 | 4 | 0 |
| 5 | 5 | 5 | 0 |
| 6 | 6 | 6 | 0 |
| 7 | 7 | 7 | 0 |
| 8 | 8 | 8 | 0 |
| 9 | 9 | 9 | 0 |
| 10 | 10 | 10 | 0 |
| 11 | 11 | 11 | 0 |
| 12 | 12 | 12 | 0 |
| 13 | 13 | 11 | 1 |
| 14 | 14 | 10 | 1 |
| 15 | 15 | 9 | 1 |
| 16 | 16 | 8 | 1 |
| 17 | 17 | 7 | 1 |
| 18 | 18 | 6 | 1 |
| 19 | 19 | 5 | 1 |
| 20 | 20 | 4 | 1 |
| 21 | 21 | 3 | 1 |
| 22 | 22 | 2 | 1 |
| 23 | 23 | 1 | 1 |
| 24 | 24 | 0 | 1 |

DISPLAY DEVICE APPARATUS, APPARATUS AND METHOD FOR DRIVING THE SAME

CROSS-REFERENCE TO RELATED APPLICATIONS

This application is a continuation application of U.S. application Ser. No. 10/863,420 filed on Jun. 8, 2004 now U.S. Pat. No. 7,321,351, which claims priority upon Korean Patent Application No. 2003-36905 filed on Jun. 9, 2003, the contents of which are herein incorporated by reference in its entirety.

BACKGROUND OF THE INVENTION

1. Field of the Invention

The present invention relates to a display device, a method and an apparatus for driving the same, more particularly to a display device, a method and an apparatus for driving the same, of which power consumption and an EMI (Electromagnetic Interference) is reduced.

2. Description of the Related Art

Generally, since the LCD device has advantages such as slim size, low power consumption and a high resolution, the LCD device is used in laptop computer and desktop computer, etc. The display panel size of the LCD device has been large enough so that the LCD device has been recently used in TV (television). The response velocity of the liquid crystal is critical when the LCD device is used in TV because moving images should be displayed in TV. Thus, it is required to enhance the response velocity of the liquid crystal in the LCD device used in TV.

The response velocity of the liquid crystal is in a range from 10 msec to 16 msec when the LCD device is used in TV. In NTSC (National Television System Committee) method, a vertical scanning frequency of the NTSC color TV has about 60 Hz, and the response velocity of the liquid crystal is evaluated for a frame, i.e. 16 msec.

In order to increase the response velocity of the liquid crystal, there have been developed two methods. First, the property of the liquid crystal has been enhanced so as to increase the response velocity of the liquid crystal. Second, the driver circuit for driving the liquid crystal display device has been developed so as to increase the response velocity of the liquid crystal.

SUMMARY OF THE INVENTION

Accordingly, the present invention is provided to substantially obviate one or more problems due to limitations and disadvantages of the related art.

According to some embodiments of the present invention, there is provided a display device of which power consumption and an EMI are reduced.

According to other embodiments of the present invention, there is provided an apparatus for driving the display device.

According to still other embodiments of the present invention, there is provided a method of driving the display device.

In some exemplary embodiments, a display device includes a display panel, a scan driver, a timing controller, and a data driver. The display panel includes a plurality of pixels, a plurality of scan lines and a plurality of data lines. The scan driver is configured to provide the scan lines with a plurality of scan driving signals in sequence. The timing controller is configured to encode first gray scale data corresponding to a present frame, configured to decode encoded second gray scale data corresponding to a previous frame, configured to compare the first gray scale data with the second gray scale data, and configure to generate compensated gray scale data based on a result of comparing the first gray scale data with the second gray scale data. The data driver is configured to generate data signal based on the compensated gray scale data to provide one of the data lines with the data signal.

In other exemplary embodiments, an apparatus for driving a display device includes a plurality of pixels, a plurality of scan lines and a plurality of data lines. The apparatus includes a timing controller and a data driver. The timing controller is configured to encode first gray scale data of a present frame, configured to decode encoded second gray scale data of a previous frame, and configured to compare the first gray scale data with the second gray scale data, and configure to generate compensated gray scale data based on a result of comparing the first gray scale data with the second gray scale data. The data driver is configured to generate data signal based on the compensated gray scale data to provide the data lines with the data signal.

In still other exemplary embodiments, a method of driving a display device having a plurality of scan lines and a plurality of data lines is performed by encoding first gray scale data corresponding to a present frame. Next, encoded second gray scale data corresponding to a previous frame are encoded. The first gray scale data are compared with the second gray scale data to generate compensated gray scale data based on a result of comparing the first gray scale data with the second gray scale data. Data signal are generated based on the compensated gray scale data to provide the data lines with the data signal.

BRIEF DESCRIPTION OF THE DRAWINGS

The above and other advantages of the present invention will become more apparent by describing in detail the preferred embodiments thereof with reference to the accompanying drawings, in which:

FIG. 9 is a table showing a total toggle number after or before the gray scale data are treated by the data transfer minimization (DTM) method.

DESCRIPTION OF EXEMPLARY EMBODIMENTS

Hereinafter the preferred embodiment of the present invention will be described in detail with reference to the accompanying drawings.

A response velocity of a liquid crystal may increase by using a driver circuit for driving a liquid crystal display device. A gray scale voltage of a previous frame is compared with a desired gray scale voltage of a present frame, and compensated gray scale voltage is generated. The compensated gray scale voltage is applied to a plurality of data lines of the liquid crystal display device so that the response velocity of the liquid crystal may increase.

Particularly, when the gray scale voltage of the previous frame is different from the desired gray scale voltage of the present frame, the compensated gray scale voltage has a level higher than that of the desired gray scale voltage of the present frame, so that the gray scale voltage applied to the data lines may reach the desired gray scale voltage of the present frame within one frame.

In a next frame, after the compensated gray scale voltage is applied to the data lines, the desired gray scale voltage is applied to the data lines, so that the response velocity of the liquid crystal may increase.

The compensated gray scale voltage (or electric charge) is determined based on a level of the gray scale voltage of the previous frame, so that the gray scale voltage applied to the data lines may reach the desired gray scale voltage of the present frame within one frame.

Figure 1:
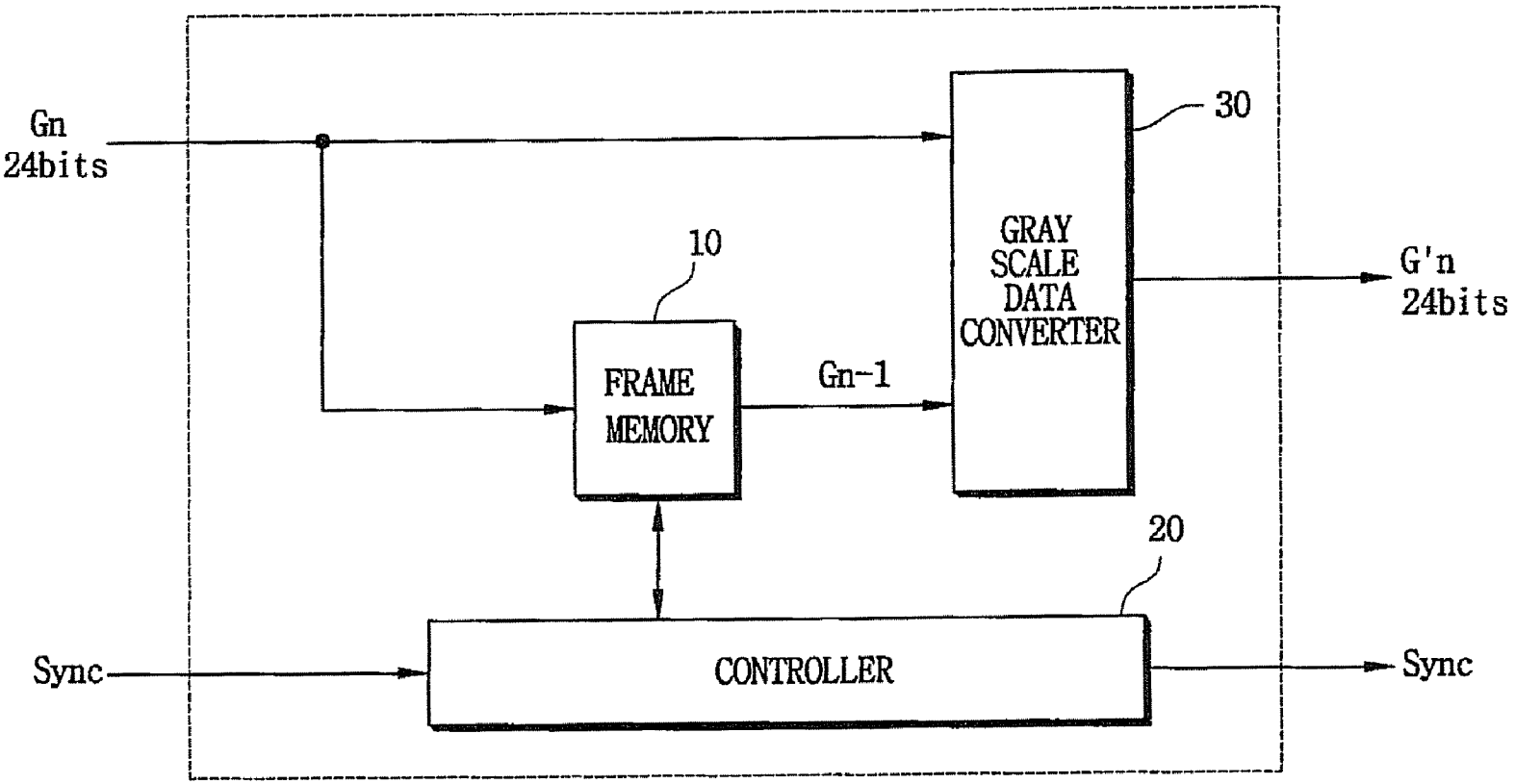
FIG. 1 is a block diagram showing a general gray scale data compensator.

FIG. 1 is a block diagram showing a general gray scale data compensator.

Referring to FIG. 1, the gray scale data compensator includes a frame memory 10, a controller 20 and a gray scale data converter 30.

The gray scale data compensator compensates original gray scale data so as to increase the response velocity of the liquid crystal, and provides a data driver of a liquid crystal display module with the compensated original gray scale data. The liquid crystal display module includes a liquid crystal display panel having a liquid crystal layer interposed between two substrates, a scan driver for providing a plurality of scan signals to a plurality of scan lines, and a data driver for providing data voltage to the data lines.

Gray scale data Gn-1, which are stored in the frame memory 10, of the previous frame are output to the gray scale data converter 30 under the control of the controller 20. Gray scale data Gn, which are transmitted from an external image source, of the present frame are stored in the frame memory 10 under the control of the controller 20. For example, the gray scale data has 24 bits, and R (red) gray scale data corresponding to red color, G (green) gray scale data corresponding to green color, B (blue) gray scale data corresponding to blue color respectively has 8 bits.

The gray scale data converter 30 receives the gray scale data Gn of the present frame and the gray scale data Gn-1 of the previous frame input from the frame memory 10. The gray scale data converter 30 generates compensated gray scale data Gn' based on the gray scale data Gn of the present frame and the gray scale data Gn-1 of the previous frame.

For example, the gray scale data converter 30 includes a look-up table that is stored in a ROM memory. The compensated gray scale data for each of the RGB gray scale data may be stored in the look-up table. The compensated gray scale voltage Vn' corresponding to the compensated gray scale data is not simply proportional to the difference between the gray scale voltage Vn-1 of the previous frame and the gray scale voltage Vn of the present frame. Since the compensated gray scale voltage Vn' is a complicated function of the difference and the absolute value of the respective gray scale voltages Vn-1 and Vn, the compensated gray scale data may be simply calculated using the look-up table rather than using other circuit.

The frame memory 10 is employed so as to increase the response velocity of the liquid crystal. The frame memory 10 stores the gray scale data in a unit of frame. For example, the frame memory 10 may be implemented independently outside the timing controller 500 (refer to FIG. 2). For example, the frame memory may be a synchronous Dynamic Random Access Memory (SDRAM) or a Double Data Rate (DDR) SDRAM.

When the frame memory is used in the gray scale data converter, the frame memory requires additional data pins for interfacing with the timing controller. The number of toggles between adjacent data pins respectively corresponding the bits of the gray scale data increases due to the additional data pins. In addition, the currents at the data pins increases. For example, when the number of the data pins is 24 and the gray scale data are simultaneously toggled at the 24 data pins, an Electromagnetic Interference (EMI) is generated due to the increased currents caused by the toggles between rising edge and falling edge. In addition, the power consumption may increase due to the increased currents at the data pins.

When the gray scale data has 24 bits, since the amount of the current variation may be changed depending on the number of toggles between adjacent data pins, it is required to reduce the number of toggles so as to reduce the power consumption and the EMI. According as the number of the bits that represents the gray scale data increases, the number of the toggles may increase, and the power consumption and EMI may increase.

Figure 2:
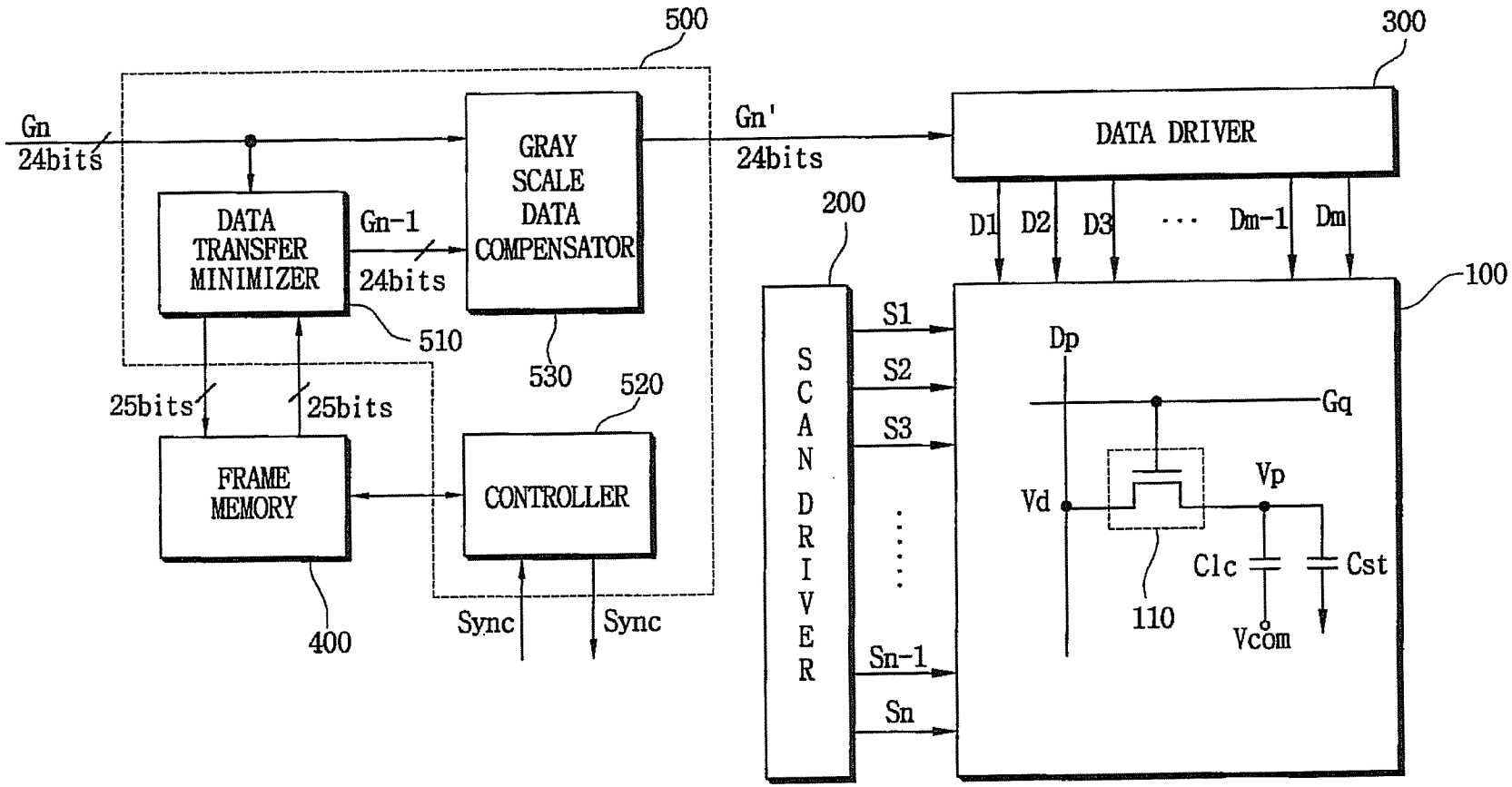
FIG. 2 is a schematic view showing a liquid crystal display device according to one exemplary embodiment of the present invention.

FIG. 2 is a schematic view showing a liquid crystal display device according to one exemplary embodiment of the present invention.

Referring to FIG. 2, the liquid crystal display device includes a liquid crystal display panel 100, a scan driver 200, a data driver 300, a frame memory 400 and a timing controller 500. The scan driver 200, data driver 300, frame memory 400 and timing controller 500 convert the original gray scale data received from an external image source into compensated gray scale data, and provides the compensated gray scale data to the liquid crystal display panel 100.

The liquid crystal display panel 100 includes a plurality of scan lines Gq and a plurality of data lines Dp. Gate driving signals (or scan signals) are provided to the scan lines, and the compensated gray scale voltages are provided to the data lines (or source lines). Each of pixels is disposed on the respective regions surrounded by the scan lines and the data lines. Each of the pixels includes a thin film transistor 110, of which gate electrode is connected to one of the scan lines Gq, and of which source electrode is connected to one of the data lines Dp. According to an equivalent circuit of a pixel, each of the pixels includes a liquid crystal capacitor C1 and a storage capacitor Cst respectively connected to a drain electrode of the thin film transistor 110.

The scan driver 200 applies scan signals S1, S2, . . . , Sn in sequence to the scan lines, and turns on the thin film transistor of which gate electrode is connected to the scan line to which one of the scan signals is applied.

The data driver 300 converts the compensated gray scale data Gn' into gray scale voltages (or data voltages), and outputs data signals D1, D2, . . . , Dm to the data lines.

The timing controller 500 includes a data transfer minimizer (DTM) 510, a controller 520 and a gray scale data compensator 530. The timing controller 500 receives first original gray scale data Gn corresponding to a present frame, encodes the first original gray scale data Gn corresponding to the present frame, and stores the encoded first original gray scale data corresponding to the present frame in the frame memory 400.

The timing controller 500 decodes encoded second original gray scale data corresponding to a previous frame, compare the decoded second gray scale data Gn-1 corresponding to the previous frame with the encoded first original gray scale data, and generates compensated gray scale data Gn' based on a result of comparing the first gray scale data Gn with the second gray scale data Gn-1 to provide the data driver 300 with the compensated gray scale data Gn'.

The data transfer minimizer 510 receives first original gray scale data Gn corresponding to the present frame from the external image source, encodes the first original gray scale data Gn corresponding to the present frame, and stores the encoded first original gray scale data corresponding to the present frame in the frame memory 400. The data transfer minimizer 510 provides the gray scale data compensator 530 with the decoded second original gray scale data Gn-1 corresponding to the previous frame The encoding operation or the decoding operation reduce the number of toggles generated at the data pins that interface the frame memory 400 and the timing controller 500. Detailed description of the encoding and decoding operations will be followed.

The controller 520 controls the frame memory 400 to store the encoded gray scale data in response to a synchronization signal (Sync). The controller 520 controls the frame memory 400 to read the encoded gray scale data from the frame memory 400 in response to the synchronization signal (Sync).

According as the gray scale data compensator 530 receives the original gray scale data Gn of the present frame, the gray scale data compensator 530 generates compensated gray scale data Gn' based on the original gray scale data Gn of the present frame and the original gray scale data Gn-1 of the previous frame.

When the original gray scale data Gn of the present frame is the same as the original gray scale data Gn-1 of the previous frame, the gray scale data compensator 530 does not perform compensational operation. However, when the original gray scale data Gn-1 of the previous frame have a gray scale corresponding to black color and the original gray scale data Gn of the present frame have a gray scale corresponding to a bright color such as a white color, the gray scale data compensator 530 compensates the original gray scale data Gn-1 of the previous frame to generate compensated gray scale data Gn' that have a gray scale higher than the gray scale corresponding to the black color.

Particularly, the gray scale data compensator 530 compares the original gray scale data Gn of the present frame with the original gray scale data Gn-1 of the previous frame to generate the compensated gray scale data Gn' for applying a gray scale voltage having an overshoot to a data line. Thus, the response velocity of the liquid crystal may be enhanced.

Alternately, the data transfer minimizer 510, controller 520 and gray scale data compensator 530 may be disposed outside of the timing controller 500, and may be connected to input terminals or output terminals of the timing controller 500.

Alternately, the liquid crystal display device further include an analog-to-digital converter by which external analog gray scale signals are converted to digital gray scale signals (i.e. the gray scale data).

Figure 3:
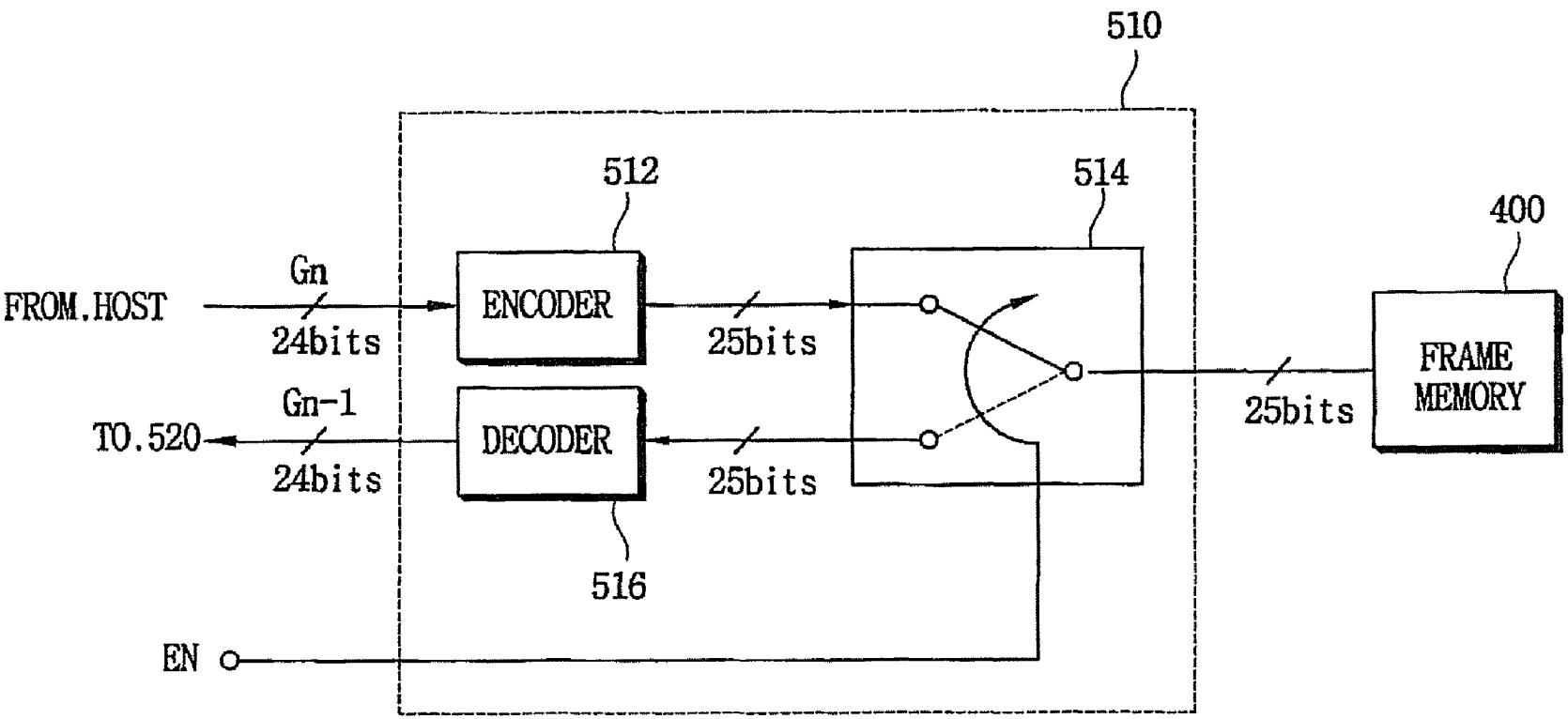
FIG. 3 is a block diagram showing a data transfer minimizer and a frame memory of FIG. 2.

FIG. 3 is a block diagram showing a data transfer minimizer and a frame memory of FIG. 2.

Referring to FIGS. 2 and 3, the data transfer minimizer (DTM) 510 includes an encoder 512, a switch 514 and a decoder 516. The data transfer minimizer (DTM) 510 encodes 24-bits gray scale data Gn supplied from an external image source to provide the encoded gray scale data to the frame memory 500, and extracts the gray scale data stored in the frame memory 400 to provide the extracted gray scale data to the gray scale data compensator 520.

The encoder 512 receives 24-bits gray scale data from the external image source, encodes the original gray scale data Gn of the present frame, generates 1-bit polarity data DPOL (refer to FIG. 4), and provide the switch 514 with the encoded gray scale data and the polarity data DPOL.

The switch 514 outputs 24-bits encoded gray scale data of the present frame and 1-bit polarity data DPOL to the frame memory 400 in response to an enable signal EN. The switch 514 outputs 24-bits encoded gray scale data of the previous frame stored in the frame memory 400 and 1-bit polarity data DPOL to the decoder 516 in response to the enable signal EN. For example, the enable signal EN may be generated based on a frame inversion signal or a line inversion signal.

The decoder 516 decodes 24-bits encoded gray scale data, which are stored in the frame memory 400, of the previous frame based on a bit value '0' or '1' of the 1-bit polarity data DPOL, and provide the gray scale data compensator with the decoded gray scale data. For example, when the polarity data has a binary bit value '0', the decoder 516 maintains the 24-bits encoded gray scale data, which are stored in the frame memory 400, of the previous frame. In addition, when the polarity data has a binary bit value '1', the decoder 516 inverts the 24-bits encoded gray scale data, which are stored in the frame memory 400, of the previous frame.

Figure 4:
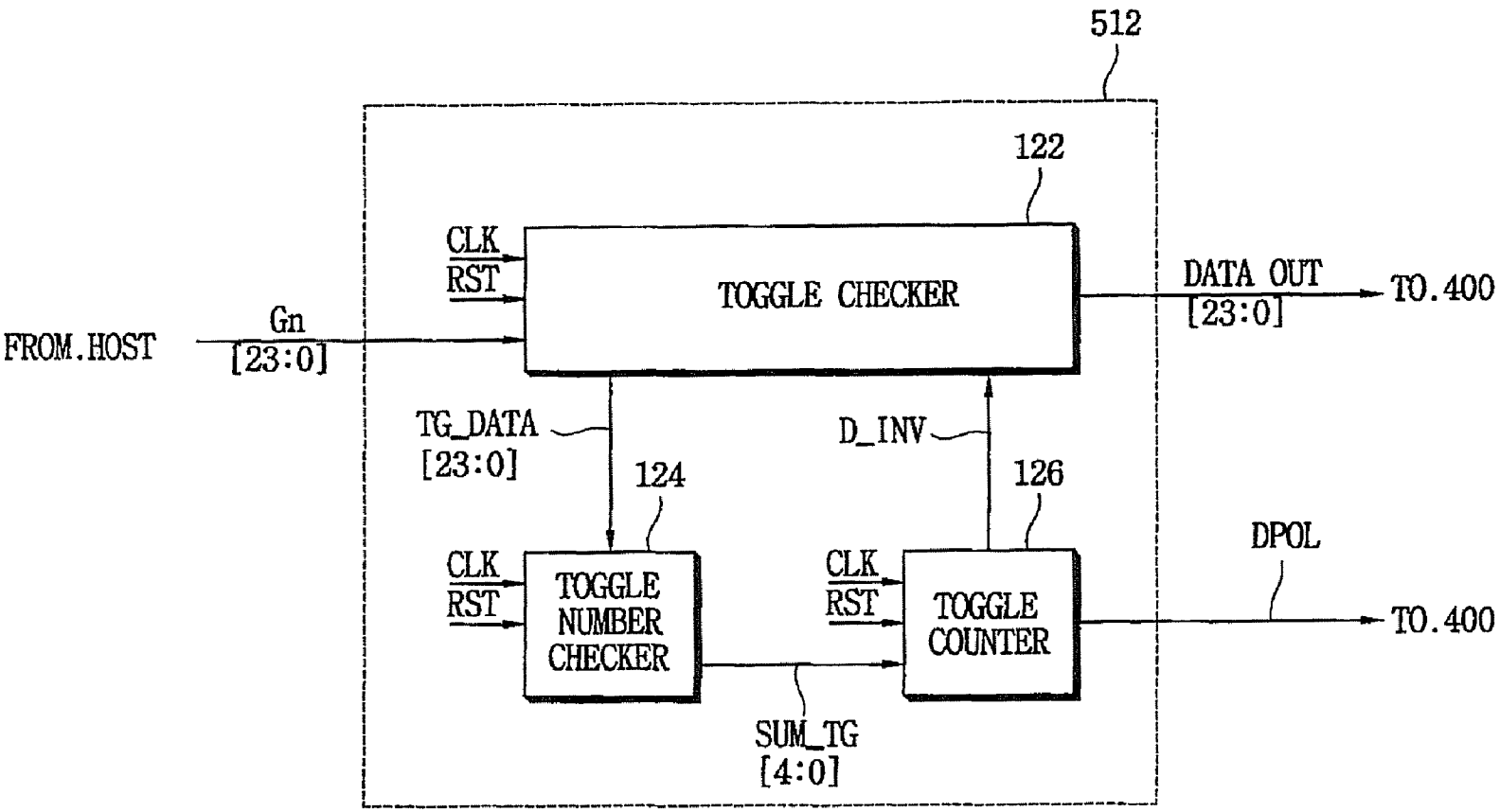
FIG. 4 is a block diagram showing an encoder of FIG. 3.

FIG. 4 is a block diagram showing an encoder of FIG. 3.

Referring to FIG. 4, the encoder 512 includes a toggle checker 122, a toggle number checker 124 and a toggle counter 126. The encoder 512 receives 24-bits original gray scale data of the present frame from the external image source, encodes the original gray scale data Gn of the present frame, and provides the 24-bit encoded gray scale data (DATA_OUT) to the frame memory 400 via the switch 514. The encoder 512 generates 1-bit polarity data DPOL based on a number of toggles in gray scale data, i.e. the number of toggles between two adjacent data pins.

The toggle checker 512 checks whether a toggle between (i) th 24-bit original gray scale data and (i−1) th 24-bit original gray scale data, and outputs 24-bit toggle data (TG_DATA) to the toggle number checker 124. The toggle checker 122 outputs the encoded gray scale data (DATA_OUT), which are an inverted or a non-inverted value of the gray scale data of the present frame, based on an inversion data D_INV to the frame memory 400. For example, the toggle data TG_DATA is obtained by performing an exclusive OR logic operation on 24-bit original gray scale data of the present frame and 24-bit original gray scale data of the previous frame. Particularly, the (n) th bit of the toggle data TG_DATA has a binary value '1' when the (n) th bit value of the 24-bit original gray scale data of the present frame is different from the (n) th bit value of the 24-bit original gray scale data of the previous frame.

For example, the 1-bit polarity data may be generated based on a number of toggles generated between first N-bit gray scale data and second N-bit gray scale data when the first N-bit gray scale data correspond to a first pixel and the second N-bit gray scale data corresponds to a second pixel adjacent to the first pixel. For example, the toggle checker 512 generates the toggle data TG_DATA by comparing third N-bit gray scale data with the second N-bit gray scale data. The third N-bit gray scale data are obtained by shifting by a clock cycle with respect to the first N-bit gray scale data.

The toggle number checker 124 sums the bit value of the toggle data TG_DATA and generates a total toggle number SUM_TG to provide the toggle counter 126 with the total toggle number SUM_TG. For example, when the 24-bit of the toggle data TG_DATA has all '1', the maximum value of the 24-bit toggle data TG_DATA may be represented by 5 bits.

When the toggle data TG_DATA are greater than or equal to a given toggle number, the toggle counter 126 generates the polarity data DPOL having a high level to output the polarity data DPOL having the high level to the frame memory 400, and to output the inversion data D_INV having the high level to the toggle checker 122.

When the toggle data TG_DATA are lower than the given toggle number, the toggle counter 126 generate the polarity data DPOL having a low level to output the polarity data DPOL to the frame memory 400, and to output the inversion data D_INV having the low level to the toggle checker 122.

Hereinafter, the operation of the encoder 512 is described.

Figure 5:
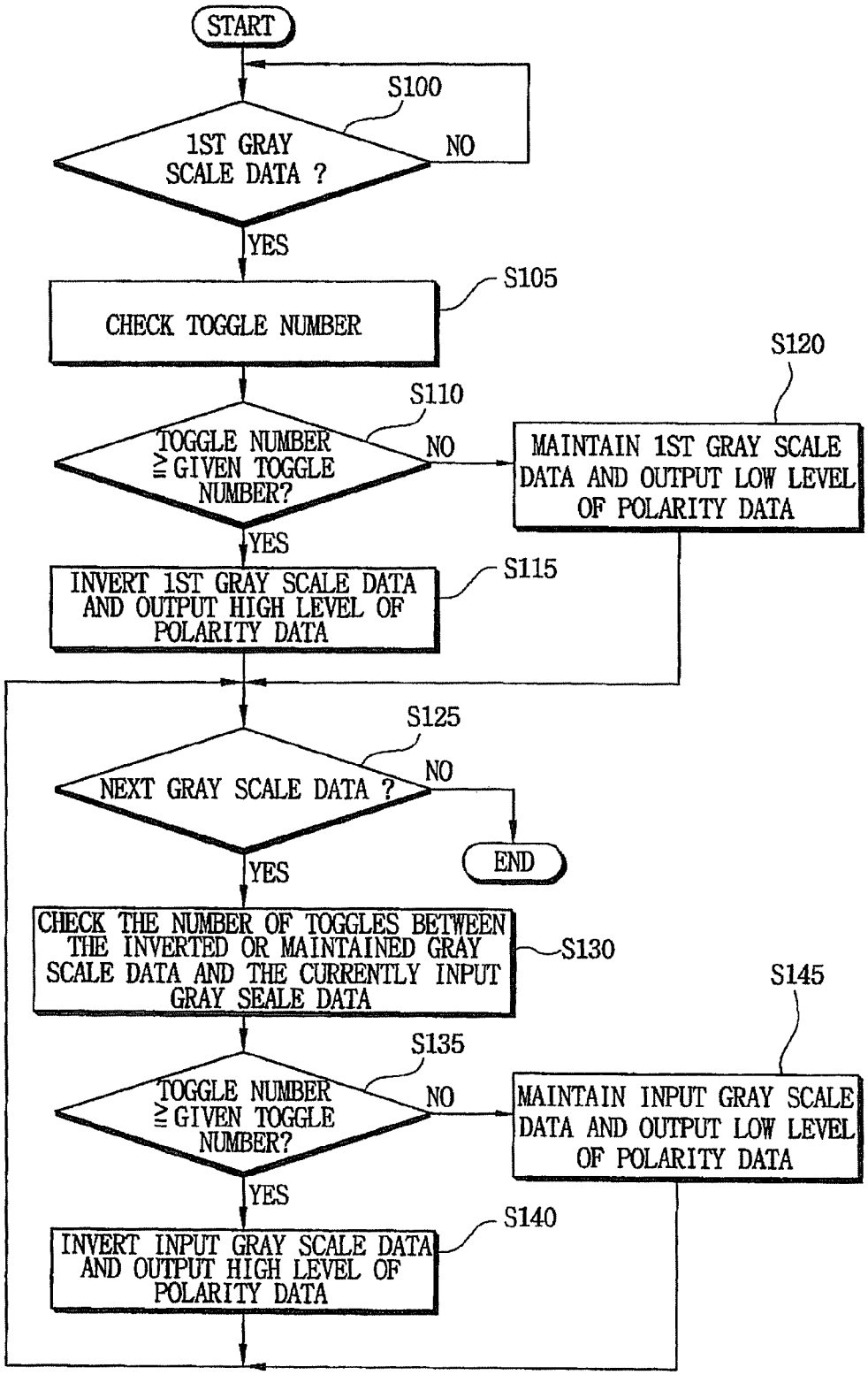
FIG. 5 is a flow chart illustrating an operation of the encoder of FIG. 3.

FIG. 5 is a flow chart illustrating an operation of the encoder of FIG. 3.

Referring to FIG. 5, it is checked whether first gray scale data corresponding to a first clock interval are input (step S100).

When the first gray scale data corresponding to the first clock interval are input, it is checked a first toggle number corresponding to a number of toggles generated between an initial value of the first gray scale data and a present value of the first gray scale data corresponding to the first clock interval (step S105). For example, the initial value of 8-bit first gray scale data has '0000 0000', and the 8-bit first gray scale data are changed into '1111 1111', the first toggle number is 8.

Next, it is checked whether the first toggle number is higher than or equal to the given toggle number (step S110). When the first toggle number is higher than or equal to the given toggle number, the first gray scale data are inverted, and the polarity data DPOL has a high level representing that the first gray scale data are inverted (step S 115). For example, each of the RGB gray scale data has 8 bits, the given toggle number may be 5.

When the first toggle number is lower than the given toggle number, the first gray scale data are not inverted, and the polarity data DPOL has a low level representing that the first gray scale data are not inverted (step S120). The first inverted or non-inverted gray scale data are referred to second gray scale data.

It is checked whether third gray scale data corresponding to a second clock interval following the first clock interval are input (step S125).

When the third gray scale data corresponding to the second clock interval are not input, the operation of the encoder 512 finishes.

When the third gray scale data corresponding to the second clock interval are input, it is checked a second toggle number corresponding to a number of toggles generated between the third gray scale data and the second gray scale data (step S130).

Next, it is checked whether the second toggle number is higher than or equal to the given toggle number (step S135). When the second toggle number is higher than or equal to the given toggle number, the second gray scale data are inverted, and a second polarity data DPOL has a high level representing that the third gray scale data are inverted (step S 140).

When the third toggle number is lower than the given toggle number, the third gray scale data are not inverted, and the polarity data DPOL has a low level representing that the third gray scale data are not inverted (step S145). The inverted or non-inverted third gray scale data are referred to fourth gray scale data.

Figure 6:
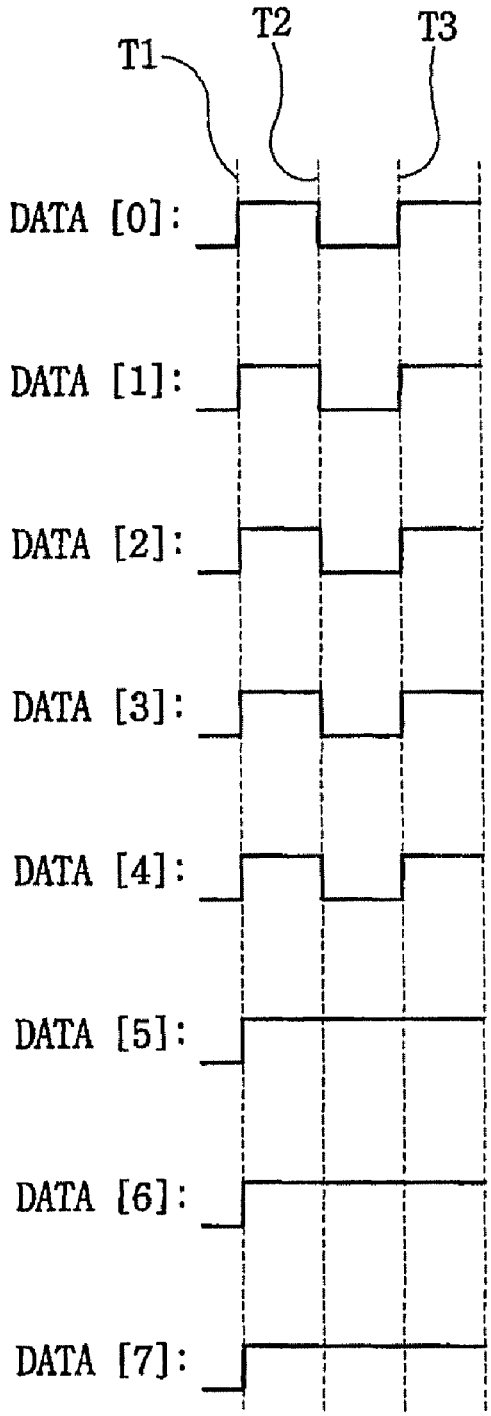
FIG. 6 is a graph showing gray scale data before the gray scale data are treated by a data transfer minimization (DTM) method.
Figure 7:
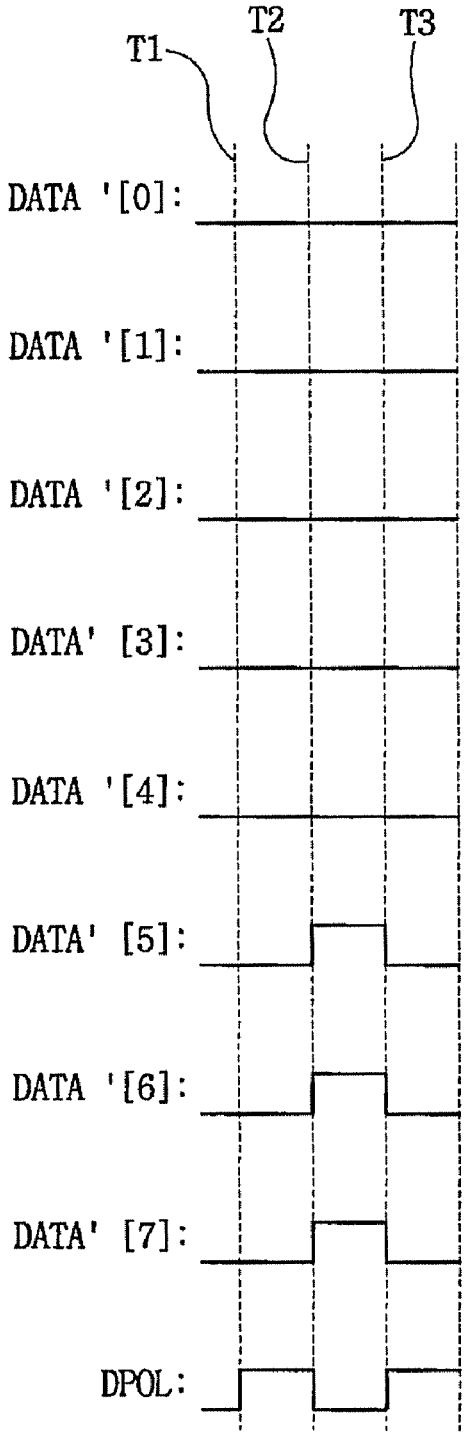
FIG. 7 is a graph showing gray scale data after the gray scale data are treated by the data transfer minimization (DTM) method.

FIG. 6 is a graph showing gray scale data before the gray scale data are treated by a data transfer minimization (DTM) method, and FIG. 7 is a graph showing gray scale data after the gray scale data are treated by the data transfer minimization (DTM) method. Hereinafter, it is assumed that gray scale data has 8 bits and the given toggle number is 5 in order to describe the data transfer minimization (DTM) method. Gray scale data are encoded using the data transfer minimization (DTM) method.

As shown in FIG. 6, at a first time point T1, the bit value of the first gray scale data DATA[7], DATA[6], . . . , DATA[0] is changed from '0000 0000' to '1111 1111', and the first toggle number is 8. Since the first toggle number is larger than the given toggle number 5, the data transfer minimization (DTM) method is applied to the first gray scale data. Thus, as shown in FIG. 7, the first gray scale data '1111 1111' is inverted to '0000 0000', and the polarity data DPOL has a high level.

At a second time point T2, since the data transfer minimization (DTM) method is performed on the previous gray scale data '1111 1111', the gray scale data '0000 0000' after the data transfer minimization (DTM) method is performed is compared with second gray scale data '1110 0000' so as to obtain a second toggle number. The second toggle number between gray scale data '0000 0000' and '1110 0000' is 3. Since the second toggle number is smaller than the given toggle number 5, the data transfer minimization (DTM) method is not applied to the second gray scale data '1110 0000'. Thus, the second gray scale data '1110 0000' is maintained, and the polarity data DPOL has a low level.

At a third time point T3, since the data transfer minimization (DTM) method is not performed on the previous gray scale data '1110 0000', the second gray scale data '1110 0000' is compared with third gray scale data '1111 1111' so as to obtain a third toggle number. The third toggle number between gray scale data '1110 0000' and '1111 1111' is 5. Since the third toggle number is equal to the given toggle number 5, the data transfer minimization (DTM) method is performed on the third gray scale data '1111 1111'. Thus, the third gray scale data '1111 1111' is inverted to '0000 0000', and the polarity data DPOL has the high level.

Gray scale data are also decoded based on the polarity data DPOL and the encoded gray scale data on which the DTM method is performed.

Particularly, when the polarity data DPOL has the high level, the encoded gray scale data, on which the DTM method is performed, may be decoded by inverting the encoded gray scale data. When the polarity data DPOL has the low level, the encoded gray scale data may be decoded by maintaining the encoded gray scale data.

Figure 8:
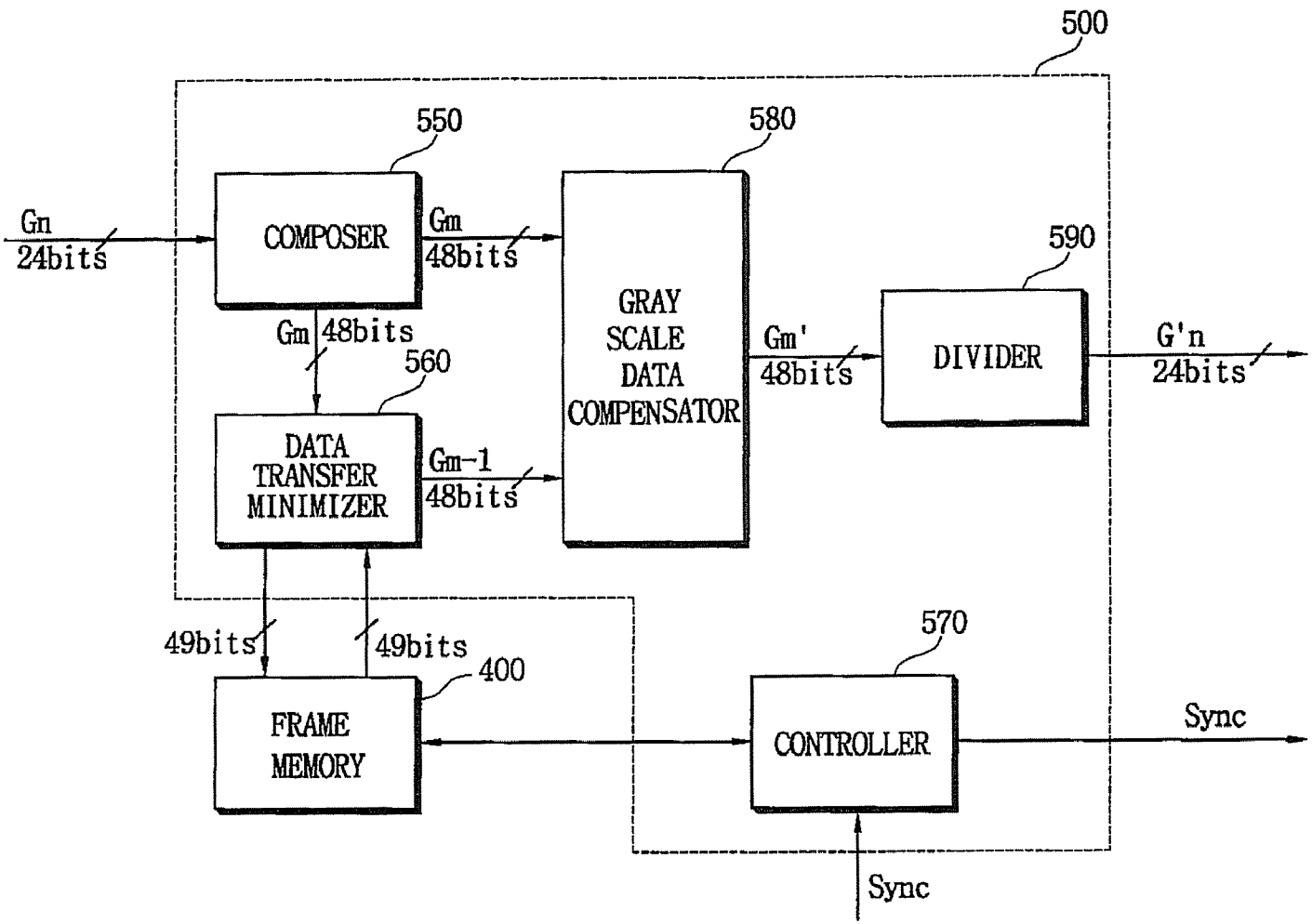
FIG. 8 is a block diagram showing a timing controller of FIG. 2 according to another exemplary embodiment of the present invention.

FIG. 8 is a block diagram showing a timing controller of FIG. 2 according to another exemplary embodiment of the present invention.

Referring to FIG. 8, the timing controller 500 includes a composer 550, a data transfer minimizer (DTM) 560, a controller 570, a gray scale data compensator 580 and a divider 590.

The timing controller 500 receives first original gray scale data Gn corresponding to a present frame from an external image source, encodes the first original gray scale data Gn corresponding to the present frame, and stores the encoded first original gray scale data corresponding to the present frame in the frame memory 400.

The timing controller 500 decodes encoded second original gray scale data, which are stored in the frame memory 400, corresponding to a previous frame, compares the decoded second gray scale data Gn-1 corresponding to the previous frame with the encoded first original gray scale data, and generates compensated gray scale data Gn' based on a result of comparing the first gray scale data Gn with the second gray scale data Gn-1 to provide the data driver 300 with the compensated gray scale data Gn'.

The composer 550 receives three 8-bit original gray scale data respectively corresponding to R (red), G (green), or B (blue) color. Namely, the composer 550 receives 24-bit original gray scale data. For example, the composer 550 may convert the sampling rate of the original gray scale data into a sampling rate available for the gray scale data compensator 580. For example, when the sampling rate of the 24-bit original gray scale data supplied from the external image source is 65 MHz and the maximum sampling rate at the gray scale data compensator 580 is 50 MHz, the composer 550 may include a down sampler (or a decimator) that converts the sampling rate 65 MHz of the 24-bit original gray scale data into 50 MHz.

Alternately, the composer 550 may receive two 24-bit original gray scale data to combine the two 24-bit original gray scale data into 48-bit original gray scale data Gm, and transmits the 48-bit original gray scale data Gm to the frame memory 400. The composer 550 may simultaneously receive 24-bit original gray scale data from the external image source. Alternately, the composer 550 may receive 8-bit original gray scale data corresponding to R (red) color, 8-bit original gray scale data corresponding to G (green) color, and 8-bit original gray scale data corresponding to B (blue) color in sequence from the external image source. Hereinafter, it is assumed that the composer 550 combines the two 24-bit original gray scale data into the 48-bit original gray scale data Gm and transmits the 48-bit original gray scale data Gm to the frame memory 400.

The data transfer minimizer 560 receives the 48-bit original gray scale data Gm corresponding to the present frame from the composer 550, decodes encoded original gray scale data corresponding to the previous frame based on the polarity data, which are stored in the frame memory 400, corresponding to the previous frame, and provides the gray scale data compensator 580 with the decoded gray scale data Gm-1 corresponding to the previous frame. The data transfer minimizer 560 encodes the received 48-bit original gray scale data Gm corresponding to the present frame. 49-bit data, which include the encoded 48-bit original gray scale data and the polarity data DPOL corresponding to the present frame, are stored in the frame memory 400.

The controller 520 controls the frame memory 400 to store the encoded gray scale data and the polarity data in response to a synchronization signal (Sync). The controller 520 controls the frame memory 400 to read the encoded gray scale data and the polarity data from the frame memory 400 in response to the synchronization signal (Sync).

According as the gray scale data compensator 580 receives the gray scale data Gm, the gray scale data compensator 580 generates compensated 48-bit gray scale data Gm' based on the original gray scale data Gm corresponding to the present frame and the original gray scale data Gm-1 corresponding to the previous frame so as to enhance the response velocity of the liquid crystal.

The divider 590 divides the compensated 48-bit gray scale data Gm' supplied from the gray scale data compensator 580 into two compensated 24-bit gray scale data Gn', and outputs the two compensated 24-bit gray scale data Gn'.

When the original gray scale data Gm corresponding to the present frame is the same as the original gray scale data Gm-1 corresponding to the previous frame, the gray scale data compensator 580 does not perform the compensational operation. However, when the original gray scale data Gm-1 corresponding to the previous frame have a gray scale corresponding to a black color and the original gray scale data Gm corresponding to the present frame have a gray scale corresponding to a bright color such as a white color, the gray scale data compensator 580 compensates the original gray scale data Gm-1 corresponding to the previous frame to generate compensated gray scale data Gn' that have a gray scale higher than the gray scale corresponding to the black color.

Particularly, the gray scale data compensator 580 compares the original gray scale data Gm corresponding to the present frame with the original gray scale data Gm-1 corresponding to the previous frame to generate the compensated gray scale data Gn' for applying a gray scale voltage having an overshoot to a data line. Thus, the response velocity of the liquid crystal may be enhanced.

Alternately, the composer 550 and the divider 590 may be disposed in the timing controller 500, the original gray scale data supplied from the external image source may be divided into first and second gray scale data, and the first and second gray scale data may be provided to the data lines on a left region and the data lines on a right side, respectively.

FIG. 9 is a table showing a total toggle number after or before the gray scale data are treated by the data transfer minimization (DTM) method. Hereinafter, it is assumed that the gray scale data supplied from the external image source have 24 bits. The total toggle number (N) is referred to a number of toggles between two adjacent data pins into which the gray scale data are output. The toggle number (N1) is referred to a number of toggles between two adjacent data pins into which the gray scale data are output when the data transfer minimization (DTM) method is not performed on the gray scale data. The toggle number (N2) is referred to a number of toggles between two adjacent data pins into which the gray scale data are output when the data transfer minimization (DTM) method is performed on the gray scale data.

As shown in FIG. 9, when the total toggle number (N) is in a range from 0 to 12, the toggle number N1 is the same as the toggle number N2, and the polarity data has a low level.

However, when the total toggle number (N) is larger than 13, the toggle number N2 decreases as the toggle number N1 increase, and the polarity data has a high level.

Thus, in case the gray scale data have 24 bits, the maximum toggle number may be less than 12 when the given toggle number is 13.

According to above described liquid crystal display device, a method and an apparatus for driving the same, the gray scale data are encoded so that the toggle number between adjacent data pins into which the gray scale data are output may be reduce. The encoded gray scale data may be stored in a memory. Thus, the power consumption may be reduced, and the EMI may be reduced.

Particularly, when the total toggle number is larger than or equal to the given toggle number, the gray scale data are inverted and the polarity data having a high level are output. When the total toggle number is smaller than the given toggle number, the gray scale data are maintained and the polarity data having a low level are output. Thus, the maximum toggle number may be reduced. In addition, when the gray scale data compensator interfaces with external frame memory, the power consumption may be reduced, and the EMI may be reduced.

Although above exemplary embodiments discuss the liquid crystal display device, organic electroluminescence devices could be utilized.

While the exemplary embodiments of the present invention and its advantages have been described in detail, it should be understood that various changes, substitutions and alterations can be made herein without departing from the scope of the invention as defined by appended claims.

What is claimed is:

1. A display device comprising:

a display panel including a plurality of pixels, a plurality of scan lines and a plurality of data lines;

a scan driver configured to provide the scan lines with a plurality of scan driving signals;

a timing controller configured to encode first gray scale data corresponding to a present frame, configured to decode encoded second gray scale data corresponding to a previous frame; and a data driver configured to provide a data signal with the display panel, wherein a number of toggles generated when the timing controller encodes is less than or equal to a number of toggles generated when the timing controller does not encode.

2. The display device of claim 1, wherein the number of toggles generated when the timing controller decodes is more than or equal the number of toggles generated when the timing controller does not decodes.

3. The display device of claim 1, wherein the timing controller generates first polarity data corresponding to the present frame based on a number of bits that is used to represent the first gray scale data, encodes the first gray scale data based on the first polarity data, and stores the first polarity data and the encoded first gray scale data in a memory.

4. The display device of claim 3, wherein the first polarity data are generated based on a number of toggles generated between first N-bit gray scale data and second N-bit gray scale data, the first N-bit gray scale data correspond to a first pixel and the second N-bit gray scale data correspond to a second pixel adjacent to the first pixel.

5. The display device of claim 3, wherein the first polarity data has a first level when a number of toggles generated between first N-bit gray scale data and second N-bit gray scale data is higher than or equal to a given toggle number, and has a second level when the number of the toggles is lower than the given toggle number, the first N-bit gray scale data correspond to a first pixel and the second N-bit gray scale data correspond to a second pixel adjacent to the first pixel.

6. The display device of claim 5, wherein the timing controller inverts the second N-bit gray scale data when the first polarity data have the first level, and maintains the second N-bit first gray scale data when the first polarity data has the second level.

7. The display device of claim 1, further including a memory for storing the encoded first gray scale data of the present frame and the encoded second gray scale data of the previous frame in a unit of frame.

8. The display device of claim 7, wherein the timing controller reads a second polarity data corresponding to the previous frame and the encoded second gray scale data corresponding to the previous frame from the memory, decodes the second gray scale data based on the second polarity data.

9. The display device of claim 1, wherein the timing controller includes:

an encoder configured to receive the first gray scale data from an image signal source, configured to encode the first gray scale data, and configured to generate the first polarity data based on a number of toggles generated between first N-bit gray scale data of the first gray scale data and second N-bit gray scale data of the first gray scale data, the first N-bit gray scale data correspond to a first pixel and the second N-bit gray scale data correspond to a second pixel adjacent to the first pixel;

a decoder configured to decode the encoded second gray scale data that are stored in a memory based on second polarity data corresponding to the second gray scale data; and a switch configured to provide the memory with the encoded first gray scale data and the first polarity data, and configured to provide the decoder with the encoded second gray scale data that are stored in the memory and the second polarity data in response to an enable signal.

10. The display device of claim 9, wherein the enable signal is generated based on a frame inversion signal.

11. The display device of claim 9, wherein the enable signal is generated based on a line inversion signal.

12. The display device of claim 9, wherein the encoder includes:

a first toggle checker configured to check whether a toggle occurs between the first and second N-bit gray scale data to generate N-bit toggle data, and configured to output third gray scale data that are obtained by inverting or maintaining the first N-bit gray scale data in response to inversion data;

a first toggle number checker configured to sum the toggle data; and a first toggle counter configured to generate the first polarity data having a first level to output the inversion data having the first level to the first toggle checker when the toggle data are greater than or equal to a given toggle number, and configured to generate the first polarity data having a second level to output the inversion data having the second level to the first toggle checker when the toggle data are lower than the given toggle number.

13. The display device of claim 12, wherein the first toggle checker generates the toggle data by comparing third N-bit gray scale data with the second N-bit gray scale data, the third N-bit gray scale data being obtained by shifting by a clock cycle with respect to the first N-bit gray scale data.

14. The display device of claim 1 wherein the decoder receives the encoded second gray scale data and the second polarity data, inverts the second gray scale data when the second polarity data has a first level, and maintains the second gray scale data when the second polarity data have a second level.

15. A method of driving a display device having a plurality of scan lines and a plurality of data lines comprising:

encoding first gray scale data corresponding to a present frame;

decoding encoded second gray scale data corresponding to a previous frame; and providing the data lines with a data signal;

wherein a number of toggles generated when a timing controller of the display device encodes is less than or equal to a number of toggles generated when the timing controller does not encode.

16. The display device of claim 15, wherein the number of toggles generated when the timing controller decodes is more than or equal the number of toggles generated when the timing controller does not decodes.

17. The method of claim 15, wherein the encoding first gray scale data corresponding to a present frame includes:

checking a first toggle number corresponding to a number of toggles generated between an initial value of third gray scale data and a present value of the third gray scale data corresponding to a first clock interval, the first gray scale data having the third gray scale data;

comparing the first toggle number with a given toggle number, encoding the third gray scale data to generate fourth gray scale data, and determining a level of first polarity data based on a result of comparing the first toggle number with the given toggle number;

checking a second toggle number corresponding to a number of toggles generated between the fourth gray scale data and fifth gray scale data, the fifth gray scale data corresponding to a second clock interval following the first clock interval; and comparing the second toggle number with the given toggle number to encode the fifth gray scale data, and determining the level of second polarity data based on a result of comparing the second toggle number with the given toggle number.

18. The method of claim 17, wherein the comparing the first toggle number with a given toggle number, encoding the third gray scale data to generate fourth gray scale data, and determining a level of first polarity data based on a result of comparing the first toggle number with the given toggle number includes:

inverting the third gray scale data to generate the fourth gray scale data and the first polarity data having a first level when the first toggle number is higher than or equal to the given toggle number; and maintaining the third gray scale data to generate the fourth gray scale data and the first polarity data having a second level when the first toggle number is lower than the given toggle number.

19. The method of claim 17, wherein the comparing the second toggle number with the given toggle number to encode the fifth gray scale data, and determining the level of second polarity data based on a result of comparing the second toggle number with the given toggle number includes:

inverting the fifth gray scale data to generate sixth gray scale data and the second polarity data having the first level when the second toggle number is higher than or equal to the given toggle number; and maintaining the fifth gray scale data to generate sixth gray scale data and the second polarity data having the second level when the second toggle number is lower than the given toggle number.

20. The method of claim 15, wherein the decoding encoded second gray scale data corresponding to a previous frame includes;

extracting encoded second gray scale data corresponding to the previous frame and polarity data corresponding to the previous frame; and decoding the encoded second gray scale data corresponding to the previous frame based on the polarity data corresponding to the previous frame.

21. The method of claim 20, wherein the decoding the encoded second gray scale data corresponding to the previous frame based on the polarity data corresponding to the previous frame includes:

inverting the encoded second gray scale data when the polarity data corresponding to the previous frame has a first level; and maintaining the encoded second gray scale data when the polarity data corresponding to the previous frame has a second level.

22. The method of claim 15, further including:

providing the scan lines with scan driving signals.

* * * * *